US012404872B1

(12) United States Patent
Hsu et al.

(10) Patent No.: US 12,404,872 B1
(45) Date of Patent: Sep. 2, 2025

(54) FAN STRUCTURE

(71) Applicant: DELTA ELECTRONICS, INC., Taoyuan (TW)

(72) Inventors: Kuo-Tung Hsu, Taoyuan (TW); Wen-Chun Hsu, Taoyuan (TW); Chao-Fu Yang, Taoyuan (TW); Cheng-Yuan Lee, Taoyuan (TW); Min-Sen Hung, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 18/918,102

(22) Filed: Oct. 17, 2024

(30) Foreign Application Priority Data

Jul. 19, 2024 (CN) ..... 202421723884.9

(51) Int. Cl.

| | |
|---|---|
| ***F04D 29/44*** | (2006.01) |
| ***F04D 25/08*** | (2006.01) |
| ***F04D 29/02*** | (2006.01) |
| ***F04D 29/40*** | (2006.01) |
| ***F04D 29/42*** | (2006.01) |

(52) U.S. Cl.
CPC ..... *F04D 29/441* (2013.01); *F04D 25/08* (2013.01); *F04D 29/023* (2013.01); *F04D 29/403* (2013.01); *F04D 29/4226* (2013.01)

(58) Field of Classification Search
CPC ..... F04D 29/441; F04D 25/08; F04D 29/023; F04D 29/403; F04D 29/4226
See application file for complete search history.

(56) References Cited

U.S. PATENT DOCUMENTS

| | | | | |
|---|---|---|---|---|
| 10,962,017 | B2 * | 3/2021 | Tsukamoto | F04D 29/023 |
| 11,258,332 | B2 | 2/2022 | Chien et al. | |
| 2010/0209270 | A1 * | 8/2010 | Yen | F04D 29/666 417/423.1 |
| 2012/0114512 | A1 * | 5/2012 | Lofy | F04D 25/0666 417/410.1 |
| 2019/0071554 | A1 * | 3/2019 | Oda | F04D 29/02 |
| 2019/0264696 | A1 * | 8/2019 | Tsukamoto | F04D 29/023 |

FOREIGN PATENT DOCUMENTS

| | | | | |
|---|---|---|---|---|
| AU | 2011378263 | A1 * | 3/2014 | F04D 17/16 |
| CA | 2849713 | A1 * | 4/2013 | F04D 17/16 |
| CN | 201486915 | U | 5/2010 | |
| CN | 105099048 | A | 11/2015 | |
| CN | 206329517 | U | 7/2017 | |
| CN | 206877271 | U | 1/2018 | |
| CN | 216642497 | U | 5/2022 | |
| CN | 218093508 | U | 12/2022 | |
| CN | 219733750 | U | 9/2023 | |
| DE | 102010042977 | A1 * | 5/2012 | F04D 29/023 |

* cited by examiner

*Primary Examiner* — Brian Christopher Delrue
(74) *Attorney, Agent, or Firm* — CKC & Partners Co., LLC

(57) ABSTRACT

A fan structure includes a fan impeller, a motor and a fan frame. The motor has a rotating shaft connected to the fan impeller. The fan frame encloses the motor and the fan impeller to form a flow passage. The fan frame has a bottom wall and a side wall. The side wall includes a first relatively hard portion and a first relatively soft portion that is exposed in the flow passage.

20 Claims, 8 Drawing Sheets

FAN STRUCTURE

CROSS-REFERENCE TO RELATED APPLICATION

This application claims priority to China Application Serial Number 202421723884.9, filed Jul. 19, 2024, which is herein incorporated by reference in its entirety.

BACKGROUND

Field of Disclosure

The present disclosure relates to a fan structure, and more particularly to the fan structure that is conducive to automated assembly.

Description of Related Art

During the operation of the fan, its motor will inevitably vibrate, resulting in collision and noise. Generally, fans are installed in electronic systems that need to dissipate heat. When the fan is operating, the generated vibration is still transmitted in the system.

Therefore, it is necessary to provide a fan structure with an integrated vibration-absorbing structure to overcome the shortcoming of insufficient vibration-absorbing effect in the prior art.

SUMMARY

The present disclosure provides a fan structure to deal with the needs of the prior art problems.

In one or more embodiments, a fan structure including: a fan impeller; a motor having a rotation shaft connected to the fan impeller; and a fan frame enclosing the motor and the fan impeller to form a flow passage, wherein the fan frame has a bottom wall and a side wall, the side wall includes a first relatively hard portion and a first relatively soft portion, wherein the first relatively hard portion has a hardness greater than a hardness of the first relatively soft portion, and the first relatively soft portion serves as a part of a wall surface of the flow passage.

In one or more embodiments, the first relatively hard portion and the first relatively soft portion are both exposed in the flow passage.

In one or more embodiments, the flow passage is an arc-shaped flow passage.

In one or more embodiments, the first relatively hard portion and the first relatively soft portion are of a unitary structure.

In one or more embodiments, an axial height of the first relatively soft portion is greater than an axial height of the fan impeller.

In one or more embodiments, an axial height of the first relatively soft portion is smaller than an axial height of the fan impeller.

In one or more embodiments, the bottom wall has a second relatively hard portion and a second relatively soft portion, the second relatively hard portion encircles the second relatively soft portion.

In one or more embodiments, the fan structure further includes an electrical connector, and the second relatively soft portion encircles the electrical connector.

In one or more embodiments, the second relatively soft portion is located between the second relatively hard portion and the electrical connector.

In one or more embodiments, a fan structure including: a fan impeller, a motor having a rotation shaft connected to the fan impeller, and a fan frame enclosing the motor and the fan impeller to form a flow passage, wherein the fan frame has a bottom wall and a side wall, the side wall includes a first plastic portion and a first different material portion, the first different material portion has a smaller hardness than that of the first plastic portion, and the first different material portion directly faces the fan impeller on a horizontal plane.

In one or more embodiments, a hardness of the first different material portion ranges from Shore A 30° to Shore A 70°.

In one or more embodiments, the first different material portion can be ethylene propylene diene monomer.

In one or more embodiments, the first different material portion can be thermoplastic elastomer.

In one or more embodiments, the first different material portion can be thermoplastic vulcanizate.

In one or more embodiments, the side wall is a unitary structure of the first plastic portion and the first different material portion formed by a dual-material injection or a secondary injection.

In one or more embodiments, the bottom wall has a second plastic portion and a second different material portion, the second different material portion has a smaller hardness than that of the second plastic portion.

In one or more embodiments, the fan structure of claim 16 further includes an electrical connector, the second different material portion encircles the electrical connector.

In one or more embodiments, the second different material portion is located between the second plastic portion and the electrical connector.

In one or more embodiments, the first different material portion and the second different material portion have the same material.

In one or more embodiments, a fan structure including: a fan impeller, a motor having a rotation shaft connected to the fan impeller, and a fan base, wherein the motor is fixed on the fan base, the fan base includes a relatively hard portion and a relatively soft portion, wherein the relatively soft portion encloses a periphery of the relatively hard portion, and the relatively soft portion directly faces the fan impeller on a horizontal plane.

In sum, the fan structure disclosed herein is conducive to automated assembly and configured with different material portions with smaller hardness on the side walls of the fan frame, around the electrical connector, the periphery of the fan base and the enclosure member of the assembly member. Therefore, when the fan structure is assembled in the system, an interface between the different material portion and the wall of the system has a sealing and waterproof effect, and the different material portion also provides a vibration-absorbing effect.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
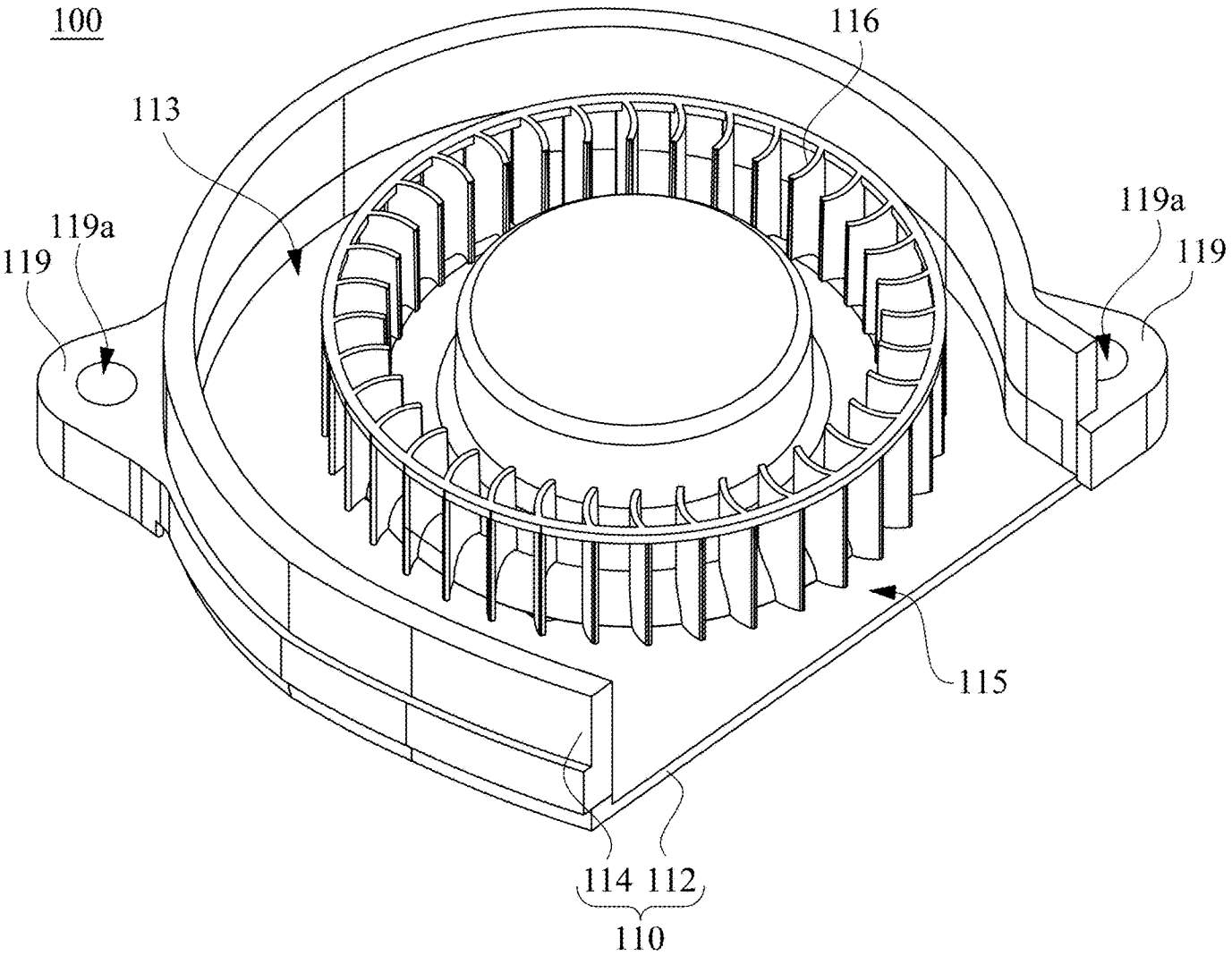
FIG. 1 illustrates a perspective view of a fan structure according to an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

Figure 4:
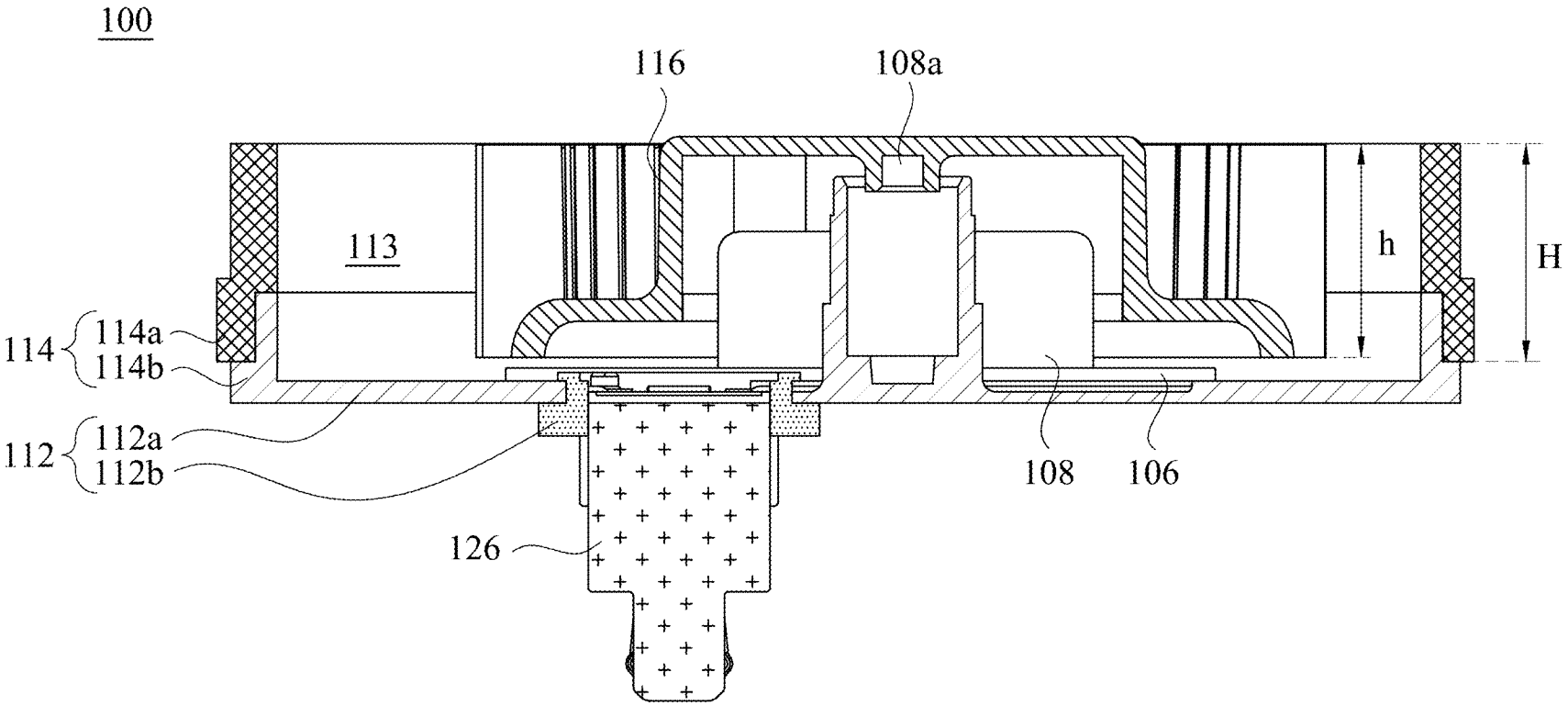
FIG. 4 illustrates a cross-sectional view of the fan structure in FIG. 1.

Reference is made to FIGS. 1 and 4, FIG. 1 illustrates a perspective view of a fan structure 100 according to an embodiment of the present disclosure, and FIG. 4 illustrates a cross-sectional view of the fan structure 100 in FIG. 1. The fan structure 100 includes a fan impeller 116, a motor 108 and a fan frame 110. The motor 108 has a rotation shaft 108*a* connected to the fan impeller 116 to drive the fan impeller 116 to rotate. The fan frame 110 covers or encloses the motor 108 and the fan impeller 116 to form a flow passage 113. The fan frame 110 includes a bottom wall 112 and a side wall 114. The side wall 114 is generally perpendicular to the bottom wall 112. In some embodiments of the present disclosure, the flow passage 113 is an arc-shaped flow passage.

In some embodiments of the present disclosure, the side wall 114 includes a different material portion 114*a* and a plastic portion 114*b*, and the different material portion 114*a* has a smaller hardness than the plastic portion 114*b*. Therefore, the different material portion 114*a* may be referred to as a relatively soft portion, and the plastic portion 114*b* may be referred to as a relatively hard portion. Specifically, a flow passage of the fan is composed of the aforementioned relatively soft portion and the aforementioned relatively hard portion. Because the hardness of the relatively hard portion is greater than the hardness of the relatively soft portion and the relatively soft portion serves as a part of a wall surface of the flow passage 113 or directly face the fan impeller 116 on the horizontal plane, the fan can further reduce air flow loss and operating volume when it is operating. In addition, the aforementioned horizontal plane refers to a plane whose normal direction is parallel to a rotation shaft 108*a*.

In some embodiments of the present disclosure, the different material portion 114*a* and the plastic portion 114*b* are integrally formed as a unitary structure. In some embodiments of the present disclosure, the different material portion 114*a* and the plastic portion 114*b* are formed into a unitary structure using a dual-material injection process. In some embodiments of the present disclosure, the different material portion 114*a* and the plastic portion 114*b* are formed into a unitary structure using a secondary injection process. In some embodiments of the present disclosure, the different material portion 114*a* and the plastic portion 114*b* of the side wall 114 are both exposed in the flow passage 113. In addition, the plastic portion 114*b* can also be made of metal or alloy as needed, which can further reduce airflow loss and operating volume when the fan is operating.

In some embodiments of the present disclosure, the different material portion 114*a* can be ethylene propylene diene monomer (EPDM), thermoplastic elastomer (TPE), thermoplastic vulcanizate (TPV) or rubber latex. In some embodiments of the present disclosure, a hardness range of the different material portion 114*a* ranging from Shore A 30° to Shore A 70°.

In some embodiments of the present disclosure, the bottom wall 112 includes a plastic portion 112*a* and a different material portion 112*b*. The different material portion 112*b* has a smaller hardness than the plastic portion 112*a*, and the plastic portion 112*a* encircles the different material portion 112*b*. Therefore, the different material portion 112*b* may be referred to as a relatively soft portion, and the plastic portion 112*a* may be referred to as a relatively hard portion. In some embodiments of the present disclosure, the plastic portion 112*a* of the bottom wall 112 and the plastic portion 114*b* of the side wall 114 are formed by the same process. In some embodiments of the present disclosure, the different material portion 112*b* and the different material portion 114*a* may be the same material or different materials, such as the above ethylene propylene diene monomer, thermoplastic elastomer, thermoplastic vulcanizate or rubber latex. In some embodiments of the present disclosure, the different material portion 112*b* and the plastic portion 112*a* are integrally formed as a unitary structure. In some embodiments of the present disclosure, the different material portion 112*b* and the plastic portion 112*a* are integrally formed as a unitary structure using a dual-material injection process or a secondary injection process.

In some embodiments of the present disclosure, the fan structure 100 further includes a control circuit board 106 and an electrical connector 126. The electrical connector 126 and the motor 108 are located on two opposite surfaces of the control circuit board 106. The electrical connector 126 is electrically connected to the control circuit board 106 and is used to plug into a corresponding slot in the system to connect to the controller and power supply. The different material portion 112*b* is used to surround or encircle the electrical connector 126 as a waterproof and shockproof barrier.

Figure 2:
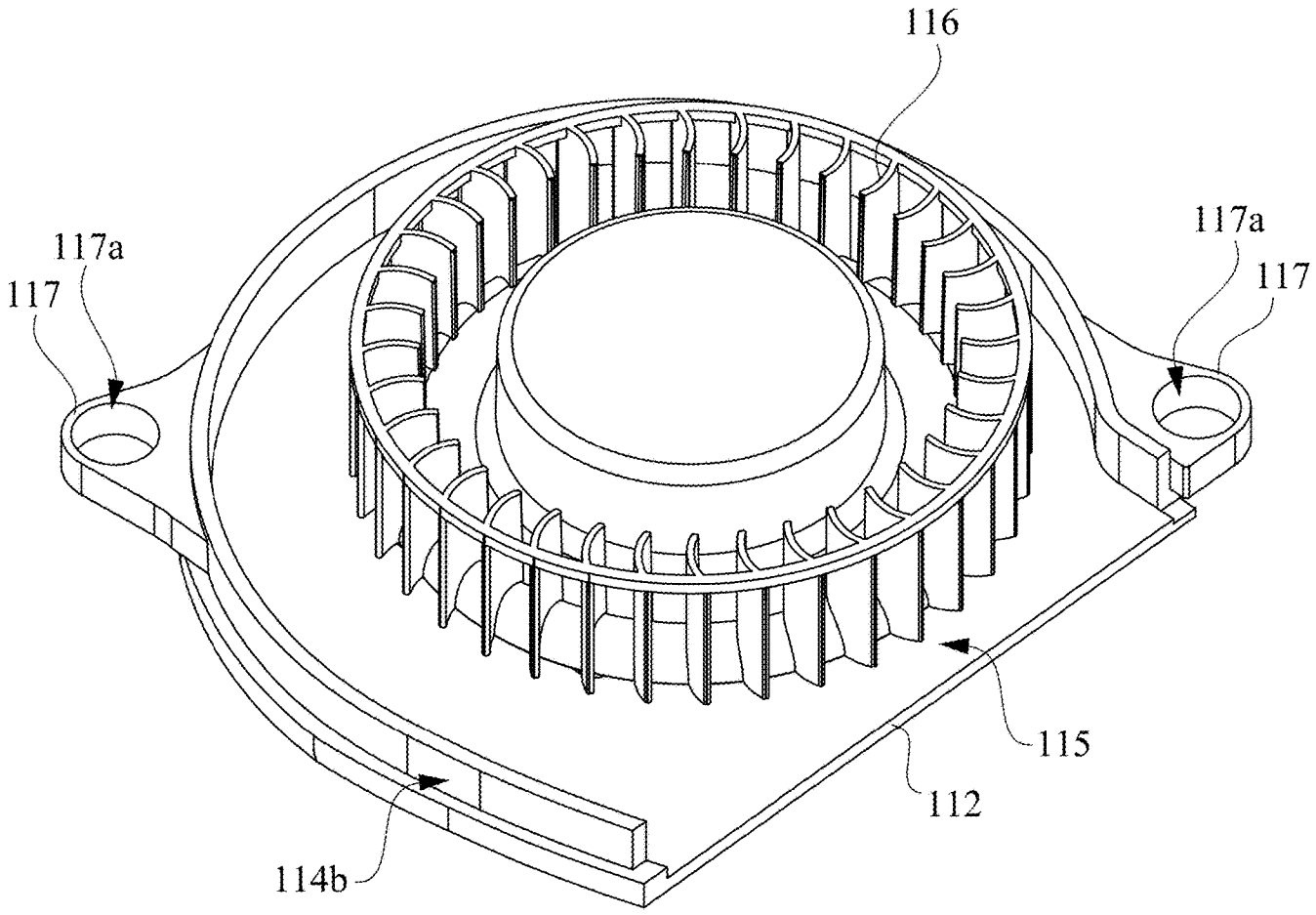
FIG. 2 illustrates the fan structure in FIG. 1 with the different material portion of the side wall being removed.

Reference is made to FIGS. 1 and 2, and FIG. 2 illustrates the fan structure in FIG. 1 with the different material portion of the side wall being removed. The fan structure 100 includes a plurality of assembly members 117 extending outward from the side wall 114. Each assembly member 117 has an assembly hole 117*a*. In some embodiments of the present disclosure, each assembly member 117 is covered by an enclosure member 119 to form a smaller assembly hole 119*a* (same as the covering relationship between the enclosure member 215 and the assembly member 213 in FIG. 8). In some embodiments of the present disclosure, the enclosure member 119 and the different material portion 114*a* may be the same material, such as ethylene propylene diene monomer, thermoplastic elastomer, thermoplastic vulcanizate or rubber latex. Since the assembly member 117 is covered by the enclosure member 119, when the fasteners (such as screws) pass through the assembly holes 119*a* to fix the assembly member 117 in a system, the vibration generated by the operation of the fan structure 100 will be absorbed by the enclosure member 119 and slowed down, and thus less likely to be transmitted to other components of the system.

Figure 3:
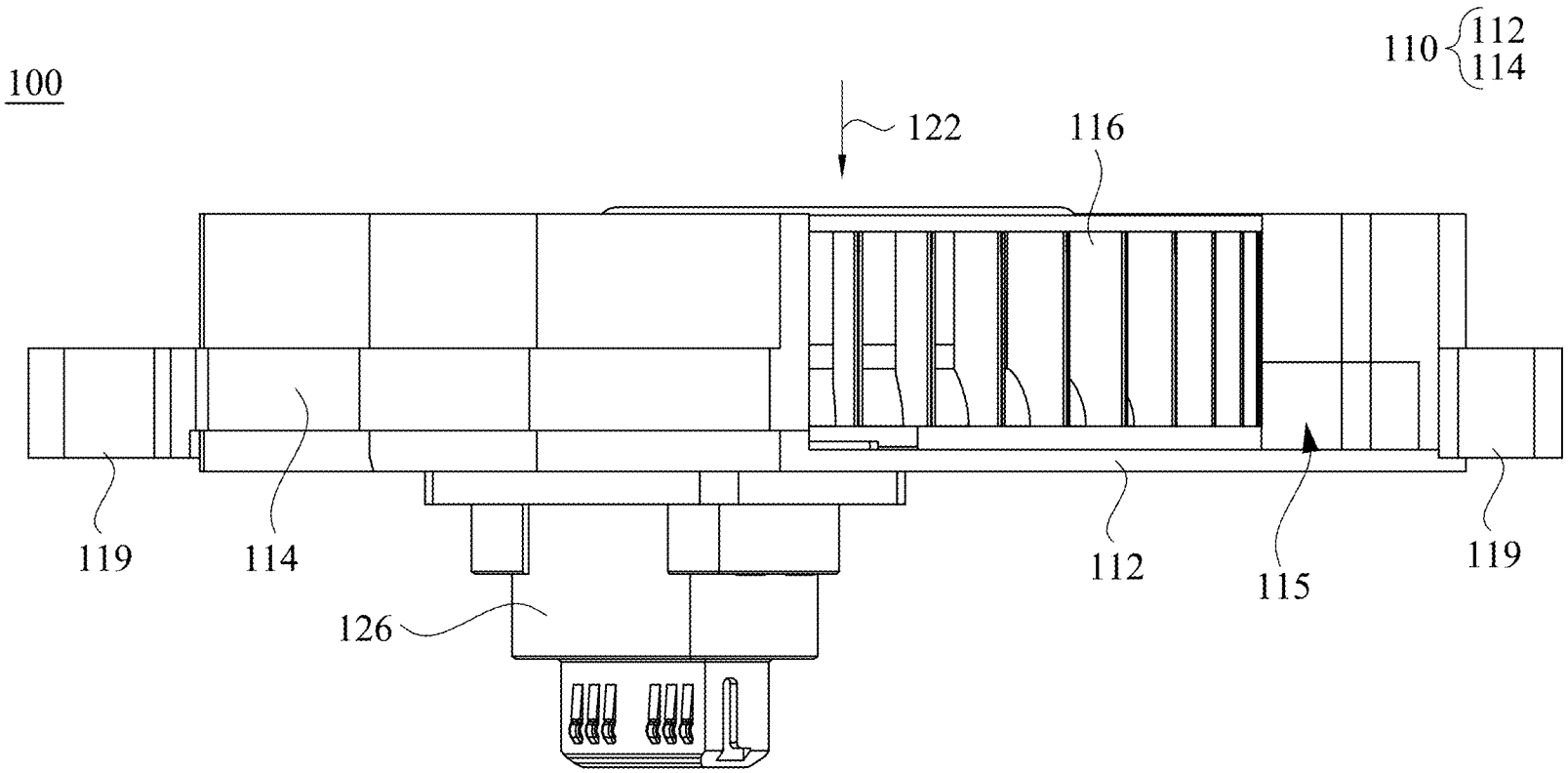
FIG. 3 illustrates a side view of the fan structure in FIG. 1.

Reference is made to FIGS. 3 and 4, and FIG. 3 illustrates a side view of the fan structure in FIG. 1. When the fan structure 100 is assembled in a system, a top edge of the different material portion 114*a* of the side wall 114 is used to abut a wall of the system, and the electrical connector 126 is used to be inserted into a corresponding slot in the system. The different material portion 114*a* is a material with a hardness ranging from Shore A 30° to Shore A 70°, which has the effect of sealing, waterproofing and vibration reduction when it contacts the wall of the system. In some embodiments of the present disclosure, the different material portion 112*b* is located between the plastic portion 112*a* and the electrical connector 126 such that the different material portion 112*b* encircling electrical connector 126 abuts the wall surface of the system also has the effects of sealing, waterproofing and vibration reduction when inserted into a corresponding slot in the system. In some embodiments of the present disclosure, an axial height H of the different material portion 114*a* is greater than an axial height h of the fan impeller 116. When the fan structure 100 is operating, airflows enter the fan in a direction 122 and then output from an air outlet 115.

Figure 5:
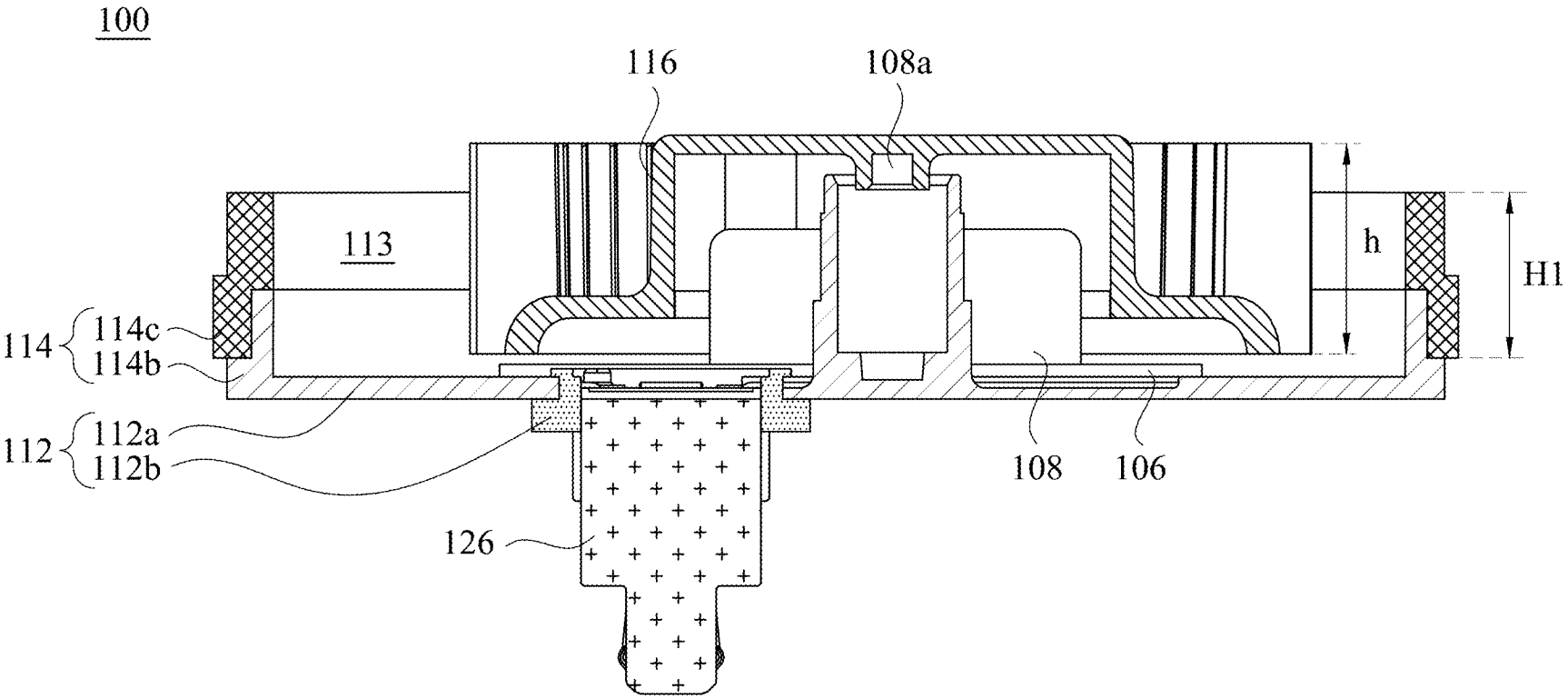
FIG. 5 illustrates a cross-sectional view of a fan structure according to another embodiment of the present disclosure.

Reference is made to FIG. 5, which illustrates a cross-sectional view of a fan structure according to another embodiment of the present disclosure. This embodiment is different from the embodiment of FIG. 4 in that the axial height of the different material portion of the side wall 114 is different. In some embodiments of the present disclosure, an axial height H1 of the different material portion 114*c* of the side wall 114 is less than an axial height h of the fan impeller 116, and can be applied to systems with different wall heights. A top edge of the different material portion 114*c* of the side wall 114 is used to abut the wall of the system. The different material portion 114*c* is a material with a hardness ranging from Shore A 30° to Shore A 70° which has the effect of sealing, waterproofing and vibration reduction when it contacts the wall of the system.

Figure 6:
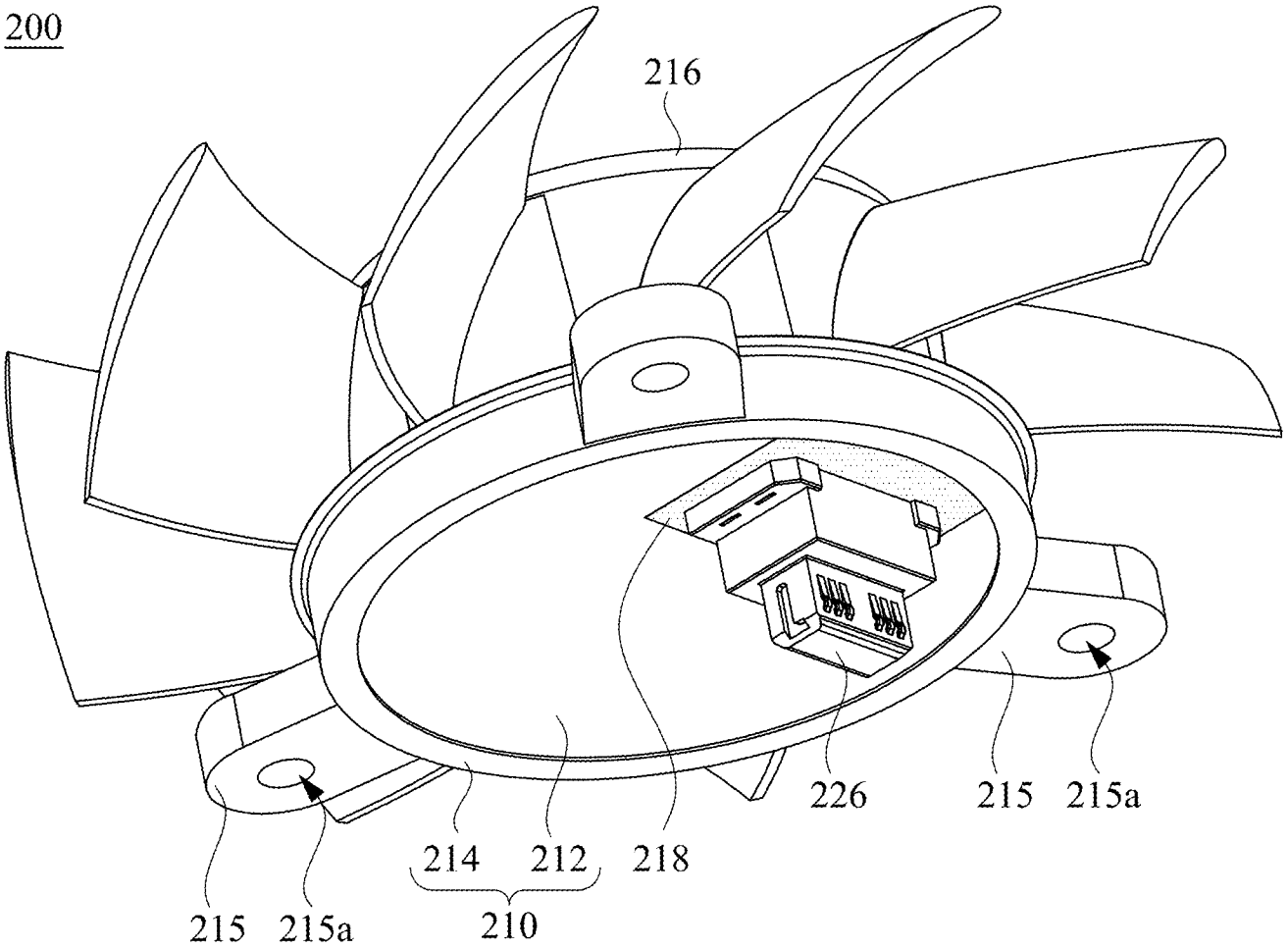
FIG. 6 illustrates a perspective view of a fan structure according to another embodiment of the present disclosure.
Figure 7:
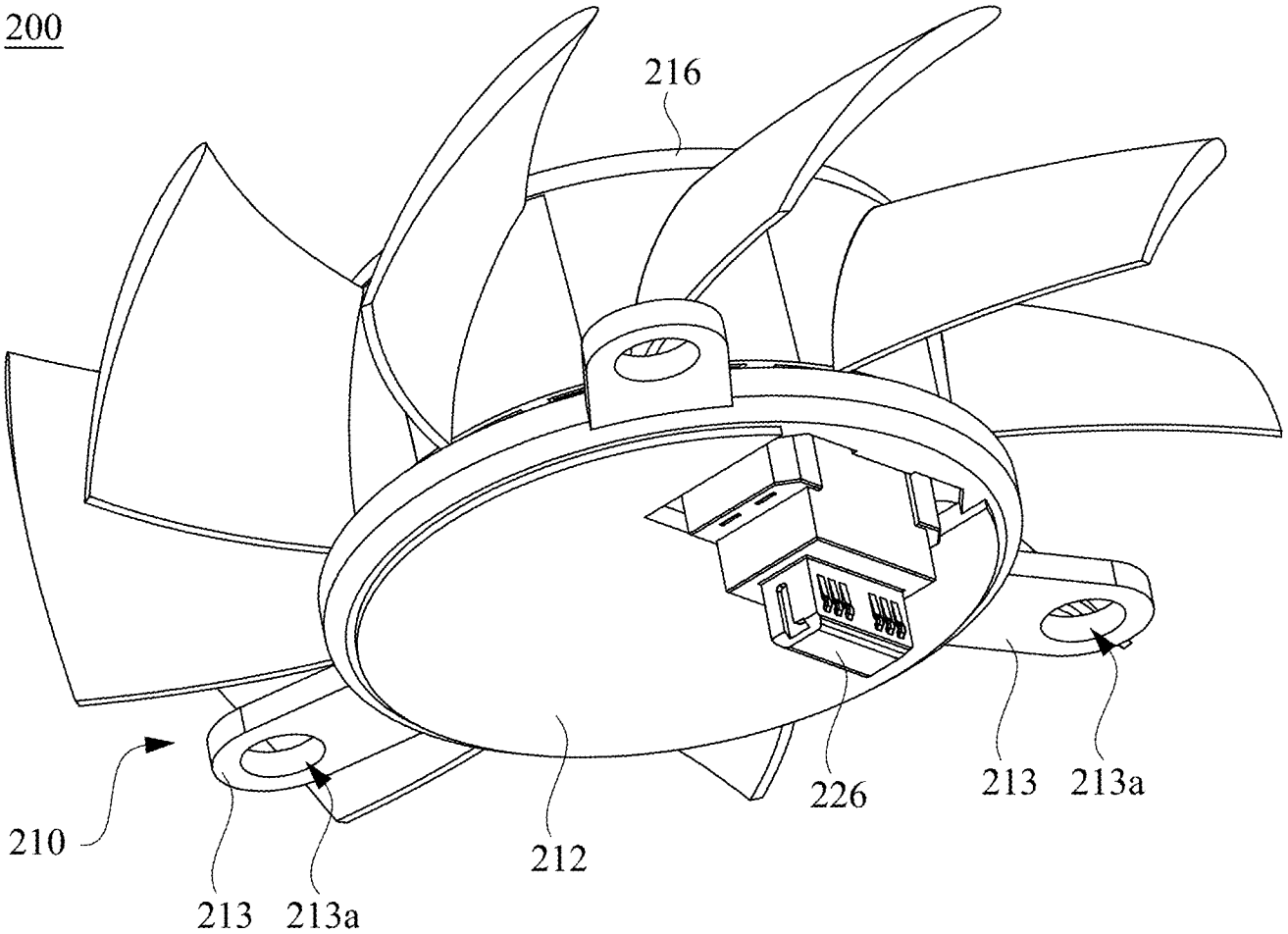
FIG. 7 illustrates the fan structure in FIG. 6 with the different material portion of the fan base being removed.
Figure 8:
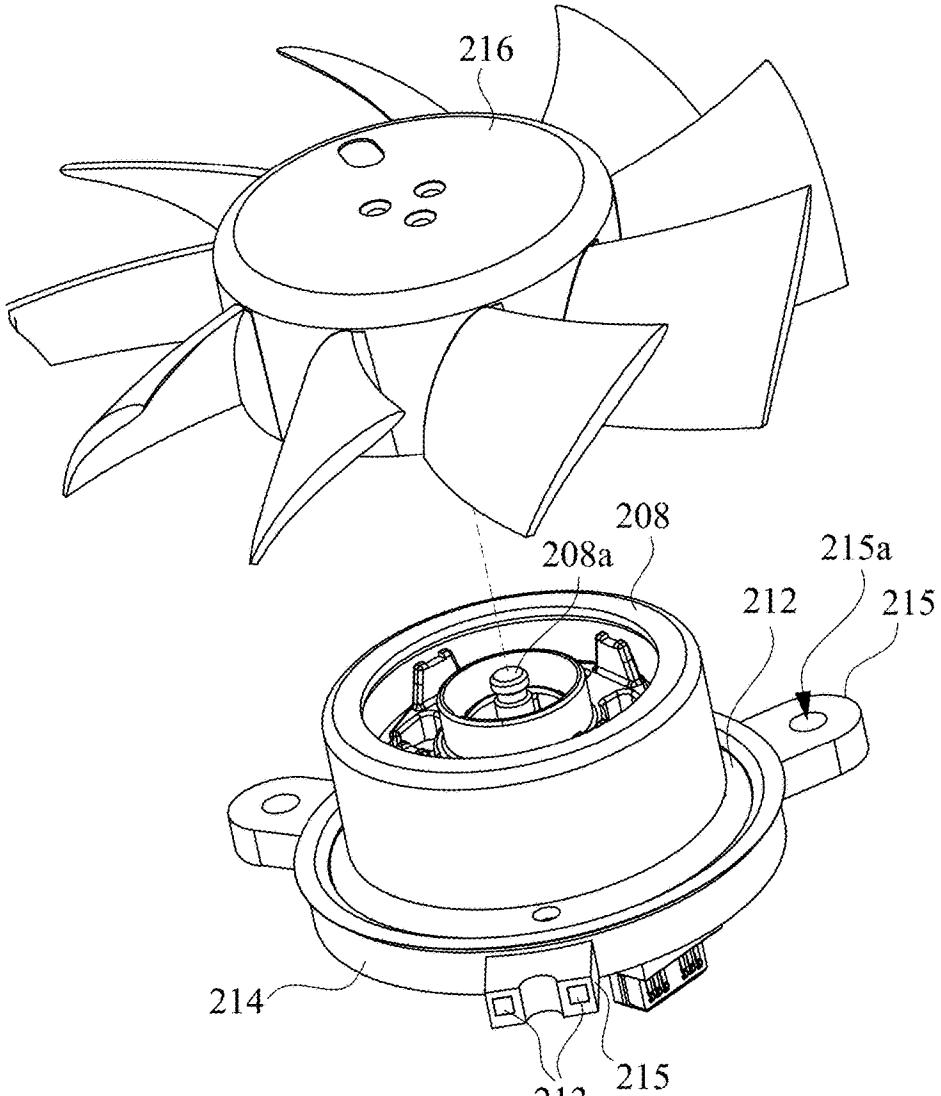
FIG. 8 illustrates an exploded view of the fan structure in FIG. 6.

Reference is made to FIGS. 6-8, FIG. 6 illustrates a perspective view of a fan structure according to another embodiment of the present disclosure, FIG. 7 illustrates the fan structure in FIG. 6 with the different material portion (214, 218) of the fan base being removed, and FIG. 8 illustrates an exploded view of the fan structure in FIG. 6, wherein a portion of an assembly member 213 and an enclosure member 215 is removed. The fan structure 200 is an axial flow fan without a fan frame. The fan structure 200 includes a fan impeller 216, a motor 208 and a fan base 210. The motor 208 has a rotation shaft 208*a* connected to the fan impeller 216, thereby driving the fan impeller 216 to rotate. The motor 208 is fixed on the fan base 210. The fan base 210 includes a plastic portion 212 and a different material portion 214. The different material portion 214 has a smaller hardness than the plastic portion 212. Therefore, the different material portion 214 may be referred to as a relatively soft portion, and the plastic portion 212 may be referred to as a relatively hard portion. In some embodiments of the present disclosure, a different material portion 214 encircles a periphery of the plastic portion 212. In some embodiments of the present disclosure, the different material portion 214 may be ethylene propylene diene monomer, thermoplastic elastomer, thermoplastic vulcanizate or rubber latex, and its hardness ranges from Shore A 30° to 70°. In some embodiments of the present disclosure, the plastic portion 212 is circular and includes a plurality of assembly members 213 extending outwardly from the circumference. Each assembly member 213 has an assembly hole 213*a*. In some embodiments of the present disclosure, each assembly member 213 is also covered by an enclosure member 215 to form a smaller assembly hole 215*a* (refer to a truncated part in FIG. 8 to see the covering relationship between the enclosure member 215 and the assembly member 213). In some embodiments of the present disclosure, the enclosure member 215 and the different material portion 214 may be the same material, such as the above ethylene propylene diene monomer, thermoplastic elastomer, thermoplastic vulcanizate or rubber latex. Because the assembly member 213 is covered by the enclosure member 215, when the fastener (such as a screw) passes through the assembly hole 215*a* to fix the assembly member 213 in a system, the vibration generated by the operation of the fan structure 200 will be slowed down by the enclosure member 215, and less likely to affect other components of the system. When the fan structure 200 is assembled in a system, a bottom surface of the different material portion 214 of the fan base 210 is used to abut the wall of the system, and an electrical connector 226 is used to be inserted into a corresponding slot in the system. The different material portion 214 is a material with a hardness ranging from Shore A 30° to Shore A 70°, which has the effects of sealing, waterproofing and vibration reduction when it contacts the wall of the system. In some embodiments of the present disclosure, the different material portion 218 extends from the different material portion 214 and encircles or surrounds the electrical connector 226. When the electrical connector 226 is inserted into the corresponding slot in the system, the different material portion 218 contacts the wall of the system and has the effects of sealing, waterproofing and vibration reduction. In some embodiments of the present disclosure, the different material portion 218 and the different material portion 214 may be the same material, such as ethylene propylene diene monomer, thermoplastic elastomer, thermoplastic vulcanizate or rubber latex.

In sum, the fan structure disclosed herein is conducive to automated assembly and configured with different material portions with smaller hardness on the side walls of the fan frame, around the electrical connector, the periphery of the fan base and the enclosure member of the assembly member. Therefore, when the fan structure is assembled in the system, an interface between the different material portion and the wall of the system has a sealing and waterproof effect, and the different material portion also provides a vibration-absorbing effect.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A fan structure comprising:

a fan impeller;

a motor having a rotation shaft connected to the fan impeller; and a fan frame enclosing the motor and the fan impeller to form a flow passage, wherein the fan frame has a bottom wall and a side wall, the side wall includes a first relatively hard portion and a first relatively soft portion, wherein the first relatively hard portion has a hardness greater than that of the first relatively soft portion, and the first relatively soft portion serves as a part of a wall surface of the flow passage.

2. The fan structure of claim 1, wherein the first relatively hard portion and the first relatively soft portion are both exposed in the flow passage.

3. The fan structure of claim 1, wherein the flow passage is an arc-shaped flow passage.

4. The fan structure of claim 1, wherein the first relatively hard portion and the first relatively soft portion are of a unitary structure.

5. The fan structure of claim 1, wherein an axial height of the first relatively soft portion is greater than an axial height of the fan impeller.

6. The fan structure of claim 1, wherein an axial height of the first relatively soft portion is smaller than an axial height of the fan impeller.

7. The fan structure of claim 1, wherein the bottom wall has a second relatively hard portion and a second relatively soft portion, the second relatively hard portion encircles the second relatively soft portion.

8. The fan structure of claim 7, further comprising an electrical connector, the second relatively soft portion encircles the electrical connector.

9. The fan structure of claim 8, wherein the second relatively soft portion is located between the second relatively hard portion and the electrical connector.

10. A fan structure comprising:

a fan impeller;

a motor having a rotation shaft connected to the fan impeller; and a fan frame enclosing the motor and the fan impeller to form a flow passage, wherein the fan frame has a bottom wall and a side wall, the side wall includes a first plastic portion and a first different material portion, the first different material portion has a hardness smaller than that of the first plastic portion, and the first different material portion directly faces the fan impeller on a horizontal plane.

11. The fan structure of claim 10, wherein the hardness of the first different material portion ranges from Shore A 30° to Shore A 70°.

12. The fan structure of claim 10, wherein the first different material portion comprises ethylene propylene diene monomer.

13. The fan structure of claim 10, wherein the first different material portion comprises thermoplastic elastomer.

14. The fan structure of claim 10, wherein the first different material portion comprises thermoplastic vulcanizate.

15. The fan structure of claim 10, wherein the side wall is a unitary structure of the first plastic portion and the first different material portion formed by a dual-material injection or a secondary injection.

16. The fan structure of claim 10, wherein the bottom wall has a second plastic portion and a second different material portion, the second different material portion has a hardness smaller than that of the second plastic portion.

17. The fan structure of claim 16, further comprising an electrical connector, the second different material portion encircles the electrical connector.

18. The fan structure of claim 17, wherein the second different material portion is located between the second plastic portion and the electrical connector.

19. The fan structure of claim 16, wherein the first different material portion and the second different material portion have the same material.

20. A fan structure comprising:

a fan impeller;

a motor having a rotation shaft connected to the fan impeller; and a fan base, the motor is fixed on the fan base, wherein the fan base includes a relatively hard portion and a relatively soft portion, wherein the relatively soft portion encloses a periphery of the relatively hard portion, and the relatively soft portion directly faces the fan impeller on a horizontal plane.

* * * * *